US011800623B2

(12) United States Patent
Leander et al.

(10) Patent No.: US 11,800,623 B2
(45) Date of Patent: Oct. 24, 2023

(54) WALL SWITCH LIGHT CONTROLLER FOR SWIMMING POOLS AND SPAS

(71) Applicant: ZODIAC POOL SYSTEMS LLC, Carlsbad, CA (US)

(72) Inventors: Jared Leander, Carlsbad, CA (US); Hwa Heng, Carlsbad, CA (US)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 0 days.

(21) Appl. No.: 17/411,446

(22) Filed: Aug. 25, 2021

(65) Prior Publication Data

US 2022/0070988 A1 Mar. 3, 2022

Related U.S. Application Data

(60) Provisional application No. 63/072,527, filed on Aug. 31, 2020.

(51) Int. Cl.
*H05B 47/175* (2020.01)
*F21V 23/04* (2006.01)
*F21W 131/401* (2006.01)

(52) U.S. Cl.
CPC ..... *H05B 47/175* (2020.01); *F21V 23/04* (2013.01); *F21W 2131/401* (2013.01)

(58) Field of Classification Search
None
See application file for complete search history.

(56) References Cited

U.S. PATENT DOCUMENTS

| | | | | |
|---|---|---|---|---|
| 9,930,763 | B1 * | 3/2018 | Trickler | H05B 47/11 |
| 10,727,731 | B1 | 7/2020 | King | |
| 2017/0006693 | A1 * | 1/2017 | Raposo | H05B 45/20 |
| 2017/0164452 | A1 * | 6/2017 | Lyons, Sr. | H04B 3/542 |
| 2018/0218855 | A1 * | 8/2018 | Lange | H05K 5/0226 |
| 2019/0005809 | A1 * | 1/2019 | Dimberg | G08C 17/02 |
| 2019/0297699 | A1 * | 9/2019 | Goldman | E04H 4/148 |

OTHER PUBLICATIONS

International Application No. PCT/US2021/047486, International Search Report and Written Opinion dated Dec. 8, 2021, 10 pages.
International Application No. PCT/US2021/047486, International Preliminary Report on Patentability dated Mar. 9, 2023, 7 pages.

* cited by examiner

*Primary Examiner* — Crystal L Hammond
(74) *Attorney, Agent, or Firm* — Kilpatrick Townsend & Stockton LLP

(57) ABSTRACT

A light controller for pool lighting systems is detailed herein. The light controller can include a switch mechanism for controlling light settings of a lighting device. Switch positions of the switch mechanism can each correspond to a different light program. When a switch is positioned at one of the switch positions, the light controller can display one or more corresponding light settings of the light program corresponding to the switch position. A user may select a light setting for the pool lighting systems based on the displayed light settings. In response to the light setting being selected, the lighting device can cause the pool lighting systems to output the selected light setting of the light program.

19 Claims, 5 Drawing Sheets

WALL SWITCH LIGHT CONTROLLER FOR SWIMMING POOLS AND SPAS

REFERENCE TO RELATED APPLICATION

This application claims the benefit of U.S. Provisional Application No. 63/072,527, filed on Aug. 31, 2020 and entitled WALL SWITCH LIGHT CONTROLLER FOR SWIMMING POOLS AND SPAS, the content of which is hereby incorporated by reference in its entirety.

FIELD OF THE INVENTION

This invention relates to devices for controlling lights in liquid-containing bodies such as swimming pools and spas.

BACKGROUND

For pool lighting, it may be desirable to control a color of light output by pool lighting systems. Selecting a desired, preprogrammed setting for the lights may present challenges. For example, the light controller for selecting the setting may be distant from the pool. As a result, the pool lights may not be visible when selecting the setting. Users unfamiliar with the preprogrammed settings may have to go back and forth between the pool and the light controller to see each light setting before reaching the desired setting.

Conventional light controllers include multiple color programs selectable in a menu of the light controller. Program selection in the menu requires the light controller to be powered at setup, but installers often do not have power during installation. Program selection in the menu is also time consuming for the installers and allows for the possibility of the user unintentionally changing the color program.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present disclosure, a lighting system includes a lighting device and a light controller. The light controller controls power and settings of the lighting device. Further, the lighting system includes a system that includes a non-transitory computer-readable medium having instructions stored thereon. The instructions are executable by a processing device to receive a first input for a first light program for the lighting device, wherein the first input corresponds to a first position of a switch. Additionally, the instructions are executable to display a first light setting of the first light program at the light controller. The instructions are executable to receive a selection input at the light controller. In response to receiving the selection input, the instructions are executable to set the lighting device to the first light setting.

Additionally, the instructions are executable to receive additional inputs for additional light programs for the lighting device, each of the additional inputs corresponding to a different switch position. The instructions are executable to display additional light settings associated with each of the additional light programs at the light controller based on the switch position.

According to certain embodiments, a light controller for regulating operation of lighting devices such as lighting devices for pool systems includes at least one light source and a switch comprising a plurality of switch positions, each switch position corresponding to a light program for the lighting devices. The at least one light source displays one or more light settings of one of the light programs based on the switch being positioned at a respective switch position. In various embodiments, the light controller is remote from the lighting devices.

According to some embodiments, a light controller for regulating operation of lighting devices for pool systems includes a switch having a plurality of switch positions, where each switch position corresponding to a light program for the lighting devices. In some embodiments, the light controller is remote from the lighting devices.

According to various embodiments, a lighting system includes a light controller for controlling power and light settings to a lighting device, where the lighting device is remote from the light controller. The lighting system also includes a computing system with a non-transitory computer-readable medium having instructions stored thereon, the instructions executable by a processing device to receive a first input for a first light program for the lighting device, where the first input corresponds to a first position of a switch. The instructions also include instructions to receive a selection input for the first light program at the light controller and set the lighting device to the first light program.

According to various embodiments, a lighting system includes a lighting device and a light controller for controlling power and light settings to the lighting device. The light controller may receive a first input for a first light program for the lighting device, where the first input corresponds to a first position of a switch. The light controller may display a first light setting associated with the first light program at the light controller, receive a selection input, and set the lighting device to the first light setting. The light controller may receive additional inputs for additional light programs for the lighting device, each of the additional inputs corresponding to a different switch position, and display the additional light settings associated with the additional light programs at the light controller based on the switch position.

According to certain embodiments, a light controller includes a switch mechanism including a switch and one or more switch positions. Each of the one or more switch positions corresponds with a different light program of a lighting device controlled by the light controller. A removable cover may be positionable over the switch.

According to some embodiments, a method for controlling a pool lighting device using a light controller includes receiving a first input for a light program for the lighting device, where the first input corresponds to a first position of a switch on the light controller. The method includes receiving a second input for a light program, where the second input corresponds to a selection of a selectable feature on the light controller different from the switch, and setting the lighting device to the light program According to certain embodiments, a light controller for regulating operation of at least one lighting device for a pool system includes a user interface having an illumination region. The light controller may control the at least one lighting device pursuant to a light program having a light setting, where the light controller displays the light setting of the light program for the at least one lighting device on the illumination region, and where the light controller is remote from the lighting devices.

According to various embodiments, a lighting system includes a light controller for controlling power and light settings to a lighting device. The light controller includes a user interface having a plurality of selectable features, each having at least one illumination region. The lighting system also includes a computing system including a non-transitory computer-readable medium having instructions stored thereon, the instructions executable by a processing device to receive an input for a light program for the lighting device, where the input corresponds to a selection of one selectable feature of the plurality of selectable features, and display a light setting associated with the light program at the light controller.

According to certain embodiments, a method for controlling a pool lighting device using a light controller includes receiving an input for a light program for the lighting device, where the input corresponds to a selection of one selectable feature of the plurality of selectable features. The method also includes displaying a light setting associated with the light program at the light controller.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures.

DETAILED DESCRIPTION

Figure 1:
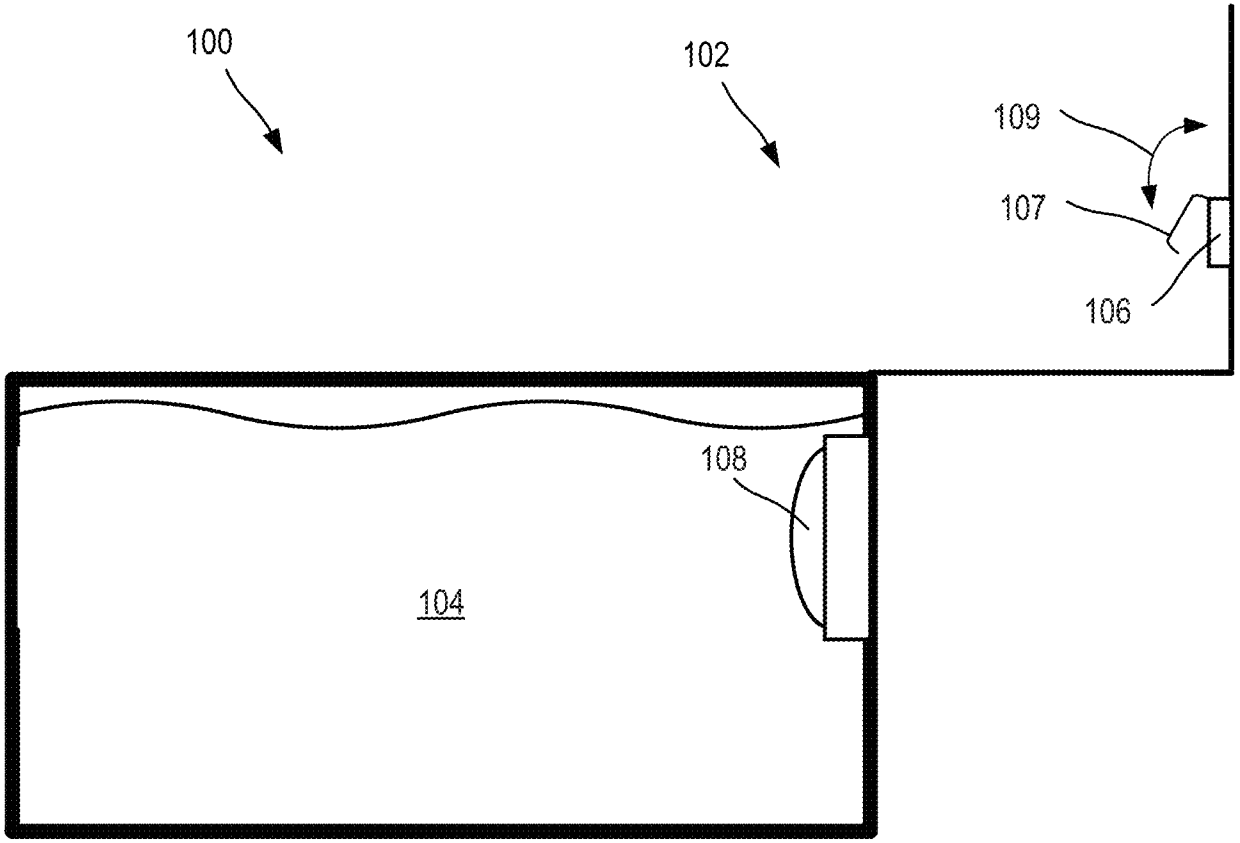
FIG. 1 illustrates a pool system with a lighting system according to embodiments.

The subject matter of embodiments is described herein with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing. Although applicant has described devices and techniques for use principally with swimming pools, persons skilled in the relevant field will recognize that the present invention may be employed in connection with other objects and in other manners. Finally, references to "pools" and "swimming pools" herein may also refer to spas or other water containing vessels used for recreation or therapy and for which cleaning is needed or desired.

Disclosed herein are devices, such as light controllers, for regulating the operation of lights in a swimming pool or spa. The light controllers are designed to allow a user to select a light setting for the pool or spa without knowledge of the pre-programmed settings and without being at a location where the lights are visible. Additionally, the light controllers allow the user to select various programs on the light controller, such that the light controller can be used with multiple types and brands of lighting devices.

A lighting system can include a light controller communicatively connected to one or more lighting devices in a pool. An example of a lighting device is a pool light. The lighting system may also include a computing device that receives input from the light controller and sends an output to the lighting devices. The lighting system can include preprogrammed light programs and settings for the lighting devices, which can be controlled by the light controller.

The light controller can include a user interface (e.g., keypad, touchscreen, etc.) and a switch. While a keypad is described herein, any type of user interface that a user can selectively engage as desired to control the lighting system may be used, including but not limited to a touchscreen. The switch can have different positions, with each position corresponding to a different light program. Each light program can include multiple light settings (e.g., colors, cycles of multiple colors, etc.). Arrow buttons and/or other selectable features on the user interface, whether tactile or virtual, can control a selection of a light setting of the selected light program. Optionally, the selectable feature (or other aspect of the user interface) can illuminate or otherwise display light to show the selected light setting for the current switch position. Each time the switch is repositioned or an arrow button (or other feature) is pressed, the keypad can illuminate to illustrate the corresponding light setting. In this way, a user can preview the various light settings of the selected program via the keypad, even when the user is remote from the lighting devices such that the lighting devices themselves are not visible to the user. When a user determines the switch is positioned for the desired light program and the desired setting of the light program is selected, the user can press a selectable feature, including but not limited to a button (whether tactile or virtual), or other area on the keypad. The button (or other area or selectable feature) then communicates with the computing device to change the output of the lighting devices to the chosen setting. The keypad and switch can replace a light switch that the user turns on and off multiple times to sequence through the different light settings.

FIG. 1 illustrates an example of a pool system 100 with a lighting system 102 according to various embodiments. The pool system 100 may be may be a pool, spa, etc. that includes a body of water 104. The lighting system 102 includes a light controller 106 and one or more lighting devices 108. In the embodiment illustrated, the lighting device 108 is provided underwater, and the light controller 106 is provided on a wall proximate to the water 104. Optionally, the light controller 106 includes a cover 107 that is movably attached to the light controller 106 to selectively provide or restrict access to the light controller 106. In one non-limiting embodiment, the cover 107 may be pivotably attached to the light controller 106 (represented by arrow 109 in FIG. 1). The number of lighting devices 108 illustrated should not be considered limiting, and the particular location of the lighting device 108 and/or the light controller 106 should likewise not be considered limiting. In certain embodiments, one or more lighting devices 108 may be provided underwater and/or outside of the pool as desired. Similarly, the light controller 106 may be provided at various locations as desired, including locations that are not necessarily proximate to the water 104 and/or locations where the lighting device 108 is not visible.

Figure 2:
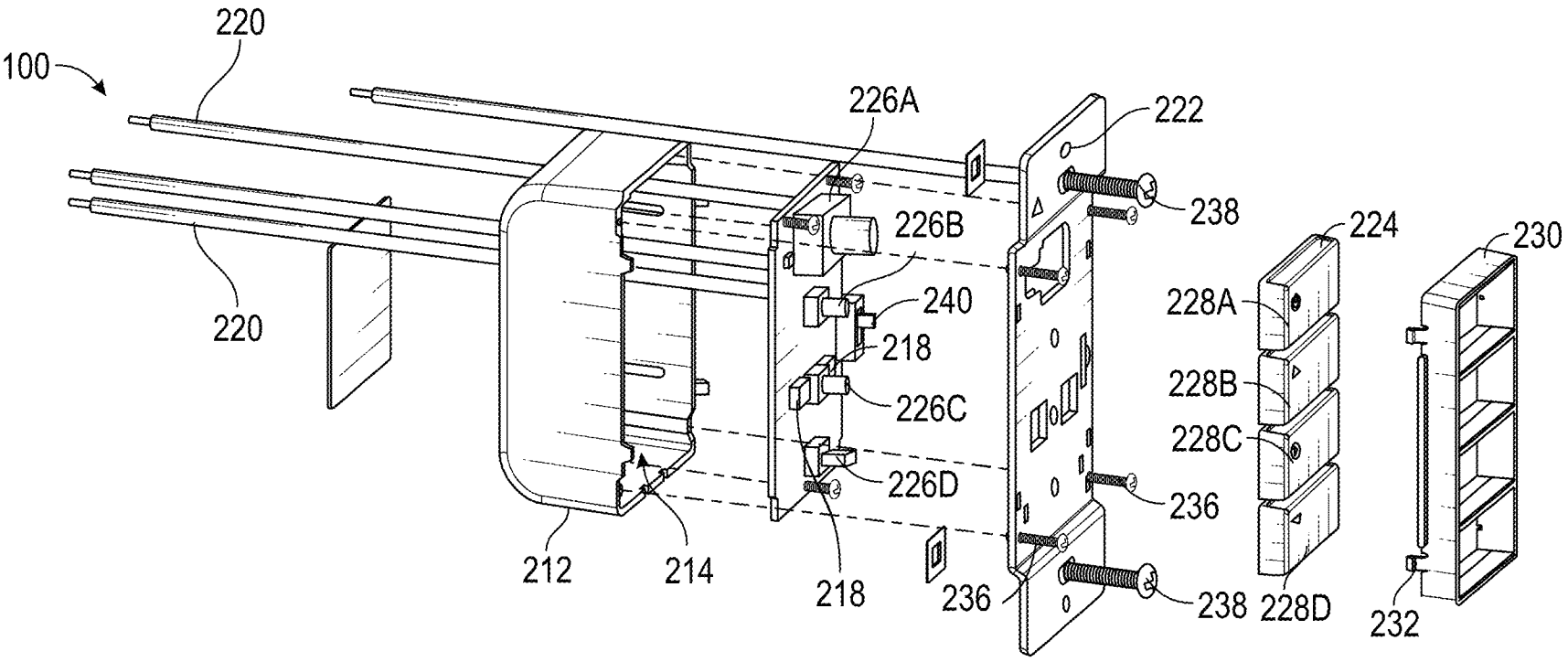
FIG. 2 is an exploded view of a light controller for a lighting system according to embodiments.
Figure 3:
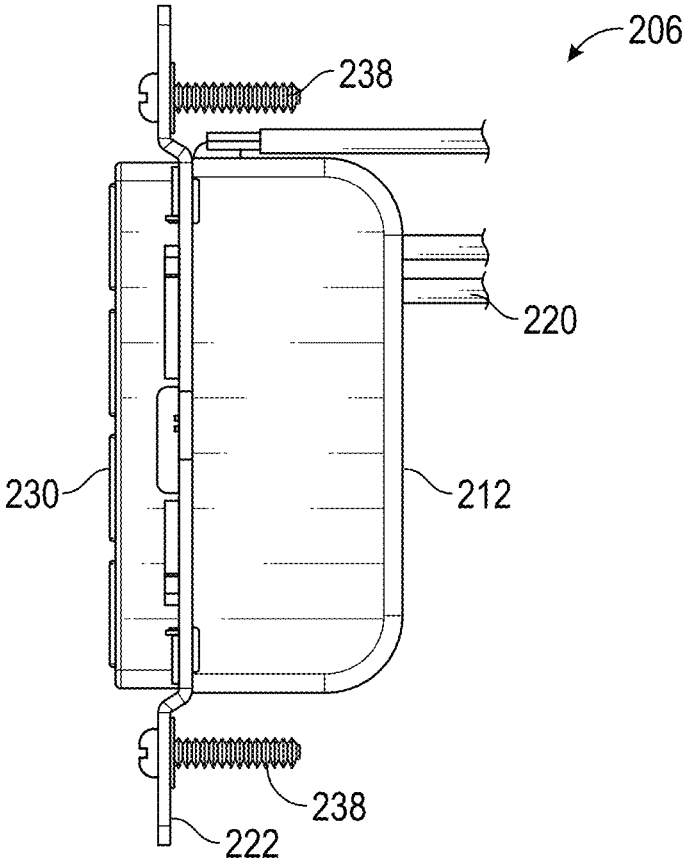
FIG. 3 is an assembled, side view of the light controller of FIG. 2.

FIGS. 2-5 illustrate another example of light controller 206 for a lighting system such as the lighting system 102 of FIG. 1. The light controller 206 may be substantially similar to the light controller 106. As illustrated in FIG. 2, for example, the light controller 206 includes housing 212 having a housing area 214 for receiving one or more components of the light controller 206. In various embodiments, a circuit board 210 of the light controller 206 is positioned inside the housing 212 when the light controller 206 is assembled (e.g., within the housing area 214).

In various embodiments, the circuit board 210 includes one or more light sources 218. The light sources 218 may be various light sources as desired, including but not limited to light-emitting diodes (LEDs). A switch mechanism 240 may be included for controlling the color of the lighting devices and is discussed in detail below. The particular location of the switch mechanism 240 should not be considered limiting. Wiring 220 can connect from the circuit board 210 to lighting devices (e.g., pool and/or spa lights such as, but not limited to, the lighting device 108) of the lighting system. Additionally or alternatively, the wiring 220 can connect from the circuit board 210 to a computing device in communication with the lighting devices.

In certain embodiments, the light controller 206 includes a circuit board covering 222 positioned over the circuit board 210 such that at least a portion of the circuit board 210 is between the covering 222 and the housing 212. The covering 222 optionally may be connected to the housing 212 using various techniques or devices as desired. In the embodiment illustrated, fasteners 236 secure the covering 222 to the housing 212. In various embodiments, the switch mechanism 240 may be accessible through the covering 222. Similarly, input receivers 226A-D may also be accessible through the cover 222. The input receives 226A-D may be selectable features including but not limited to switches, contacts, buttons, and/or other components or devices or selectable features that receive a user input (e.g., optionally using a button or switch) and convert that input into an electrical signal that could be used by a computing device or as otherwise desired.

Figure 4:
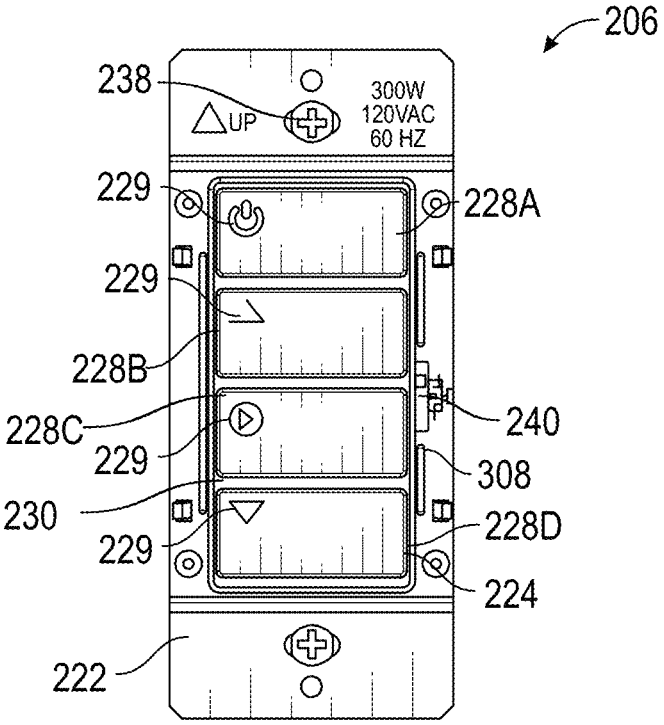
FIG. 4 is a view of the keypad of the light controller of FIG. 2.

A keypad 224 can be positioned on the circuit board covering 222. In various embodiments, the keypad 224 includes selectable features corresponding to the input receivers 226A-D on the circuit board 210 that, when engaged, control aspects of the lighting devices. In certain aspects, the selectable features may be tactile features or components, virtual features or components, and/or other types of components or features as desired. In the embodiment illustrated, the selectable features are buttons 228A-D, although in other embodiments other types of selectable features may be utilized as desired. The buttons 228A-D may be various types of buttons as desired. For example, the keypad 224 can have a power button 228A for turning on and off the lighting devices, cycle buttons 228B and 228D for controlling the color of the lighting devices, and a play button 228C for displaying a selected color setting of the lighting devices. The number, type, and location of the buttons 228A-D and input receivers 226A-D should not be considered limiting. In certain aspects, and as best illustrated in FIG. 4, one or more buttons includes an illumination region 229 that may be at least partially transparent and/or otherwise enable viewing of light emitted from the light sources 218. In the embodiment illustrated, the illumination region 229 includes a portion of the particular buttons, although in other embodiments the entire button may be an illumination region/enable viewing of light emitted from the light sources 218. In certain embodiments, and as discussed in detail below, the illumination region(s) 229 optionally may be used for displaying the different light settings of a selected program. Moreover, while each button is illustrated with an illumination region 229, in other embodiments, each button need not include an illumination region.

A front panel 230 can be positioned over the keypad 224. In certain embodiments, the front panel 230 may maintain positioning of the keypad 224 relative to the covering 222 and/or the circuit board 210. In certain embodiments, the front panel 230 optionally may be connected to the covering 222 using various techniques as desired. In the embodiment illustrated, the front panel 230 includes tabs 232 that form a snap-fit connection with apertures 234 in the covering 222.

In certain embodiments, the light controller 206 may also optionally include a cover similar to the light cover 107 positioned over the front panel 230. In certain embodiments, the cover may be movably connected to the light controller 206 to selectively allow or prevent access to the keypad 224. As a non-limiting example, the cover may be hingedly or pivotably attached to the light controller 206 to selectively cover and uncover portions of the light controller 206. When included, the cover may prevent a setting of the lighting devices from being changed unintentionally. When the cover is lifted or removed, the keypad 224 can be accessible to a user.

In some embodiments, the light controller 206 can be fastened to a wall or other structure with screws 238 or other fasteners or devices as desired. However, those skilled in the art will recognize that the light controller 206 could be secured to the wall or other structure in any suitable way.

Figure 5:
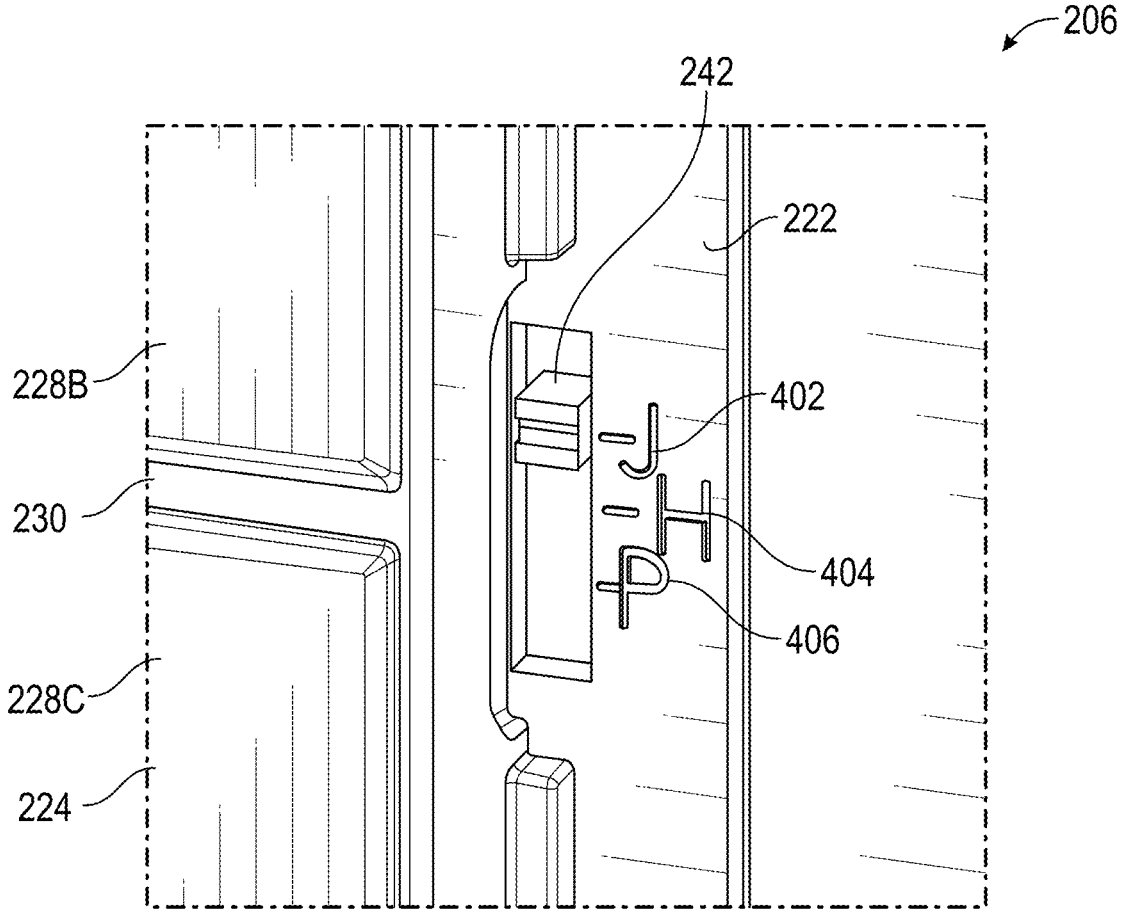
FIG. 5 is a view of the switch mechanism of the light controller of FIG. 2.

Referring to FIGS. 4 and 5, control of lighting devices using the light controller 206 is described in greater detail. As mentioned, the light controller 206 can include one or more buttons, including but not limited to the power button 228A, the play button 228C, and the cycle buttons 228B and 228D. Such buttons can be communicatively connected to the circuit board 210 for controlling aspects of the pool. In some embodiments, and as best illustrated in FIG. 5, the switch mechanism 240 may be controlled for controlling aspects of the pool.

As one non-limiting example, the power button 228A may be used for turning on and off the lighting devices. When pushed a first time, the power button 228A can turn the lighting devices on. When the power button 228A is pushed a second time, the lighting devices can be turned off.

Additionally, the switch mechanism 240 may be controlled for selecting a program for the lighting devices. The switch mechanism 240 can include multiple positions for a switch 242 of the switch mechanism 240 to be positioned. In certain embodiments, each position can correspond to a different, preprogrammed light program of the lighting devices. In some embodiments, each of the light programs can include one or more pre-defined light settings or light characteristics, such as a single light color, a cycle of multiple light colors, always-on settings, a blinking pattern, a brightness, etc., or any desired combination. As one particular non-limiting example, a first position can correspond to a light program of one manufacturer for the lighting devices and a second position can correspond to a light program of a second manufacturer for the lighting devices. FIG. 5 illustrates an example where the switch mechanism 240 includes switch positions such as 402, 404, and 406 that the switch 242 can be positioned. While three switch positions are illustrated, the switch mechanism 240 can include any number of switch positions. In the embodiment illustrated in FIG. 5, each of the switch positions 402, 404, and 406 can correspond to a different program for the lighting devices. The programs can include color settings and/or flashing or other pattern settings. For example, switch position 402 can correspond to a first program with one color sequence, switch position 404 can correspond to a second program with three color sequences, and switch position 406 can correspond to a third program with two color sequences. In some examples, the switch positions 402, 404, and 406 can be labeled (e.g., "J", "H", and "P").

As another non-limiting example, the play button 228C may be used for displaying light settings of the selected program for the lighting devices to the user and for changing the lighting devices to the selected setting. In certain aspects, one or more of the light sources 218, such as one or more LEDs, can be positioned on the circuit board 201 such that light from the LEDs is visible through the play button 228C of the keypad 224. In such embodiments, the covering 222 may include apertures corresponding the light sources 218. In various embodiments, when the user sets the switch mechanism 240 to a desired position, the play button 228C can illuminate (e.g., through illumination region 229) to illustrate a corresponding color/color pattern of the selected program corresponding to the position of the switch. The LEDs can cycle through colors or blink at predefined intervals when the program includes such settings.

As a further non-limiting example, the cycle buttons 228B and 228D, illustrated in FIG. 4 as up and down buttons, can be used to change between light settings within the light program corresponding to the position of the switch mechanism 240. For example, the first position of the switch mechanism 240 can correspond to a light program with a red setting, and a cycle of red, blue, and green. When the switch mechanism 240 is in the first position, the play button 228C illuminates red (e.g., the first setting of the light program). When the user presses the cycle button 228B or the cycle button 228D, the play button illuminates and cycles through red, blue, and green (e.g., the second setting of the light program). In addition to displaying the selected setting, the play button 228C can be pressed to select the light setting corresponding to the position of the switch mechanism 240 and the light setting within the program being displayed. In response to the play button 228C being pushed, the lighting system can perform an on/off sequence to change the lighting devices to the desired light setting of the selected program.

Figure 6:
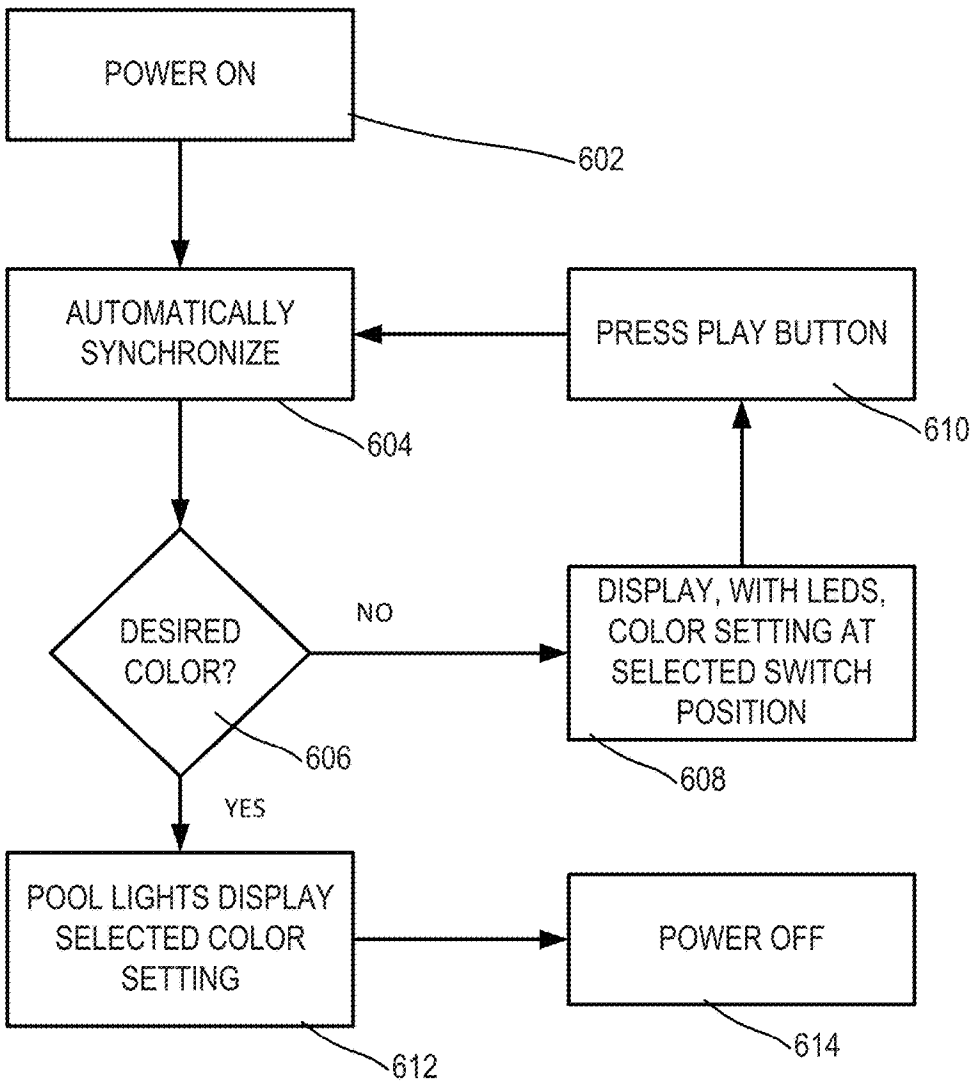
FIG. 6 is a flowchart of an exemplary process of selecting a light setting using the light controller of FIG. 2.

FIG. 6 illustrates an exemplary process for controlling lighting devices (such as pool and/or spa lights) with a light controller. At block 602, the lighting devices are powered on. A user can push a power button (e.g., power button 228A in FIG. 2) to turn on the lighting devices. The lighting devices can turn on to a default setting, or the lighting devices can come on at a setting corresponding to the program of the switch position from a previous session.

At block 604, the lighting devices can automatically synchronize. The lighting devices can automatically synchronize to the setting corresponding to the switch position of the switch mechanism. For example, a first switch position can correspond to a program with a setting of red for the lighting devices. The lighting devices can automatically synchronize to red after determining the switch mechanism is in the first position.

At block 606, a user can determine if the current setting corresponds to the desired color and/or pattern. In response to determining the lighting devices are set to the desired color program and setting, the lighting devices can continue operating at the selected setting. If the lighting devices are not set to the desired color setting or program, the user can proceed to block 608.

At block 608, the light controller can display the color setting at the selected switch position using LEDs. The LEDs can be positioned such that they are visible through a play button (e.g., play button 228C in FIG. 3), or a portion of the play button (e.g., illumination region 229). The user can reposition the switch or press additional buttons of the light controller until the LEDs display the desired color setting. The user can determine, based on the LEDs, that the switch is at the desired color program position and at the desired color setting. The user can make this determination even if the lighting devices themselves are not visible to the user.

At block 610, the user can press the play button in response to determining the switch is positioned at the desired color program position and the desired color setting within the program is selected. A computing device associated with the light controller can perform a sequence of operations to change the lighting devices to the color setting corresponding to the switch position and the selected setting of the program. The light controller can proceed to block 604 to automatically synchronize the lighting devices.

At block 612, the lighting devices can display the selected color setting. The computing device can control the output of the lighting devices based on the selected position of the switch mechanism and the selected setting within the program of the selected position. The lighting devices can continue displaying the selected color setting until the light controller indicates a change in the selected color setting.

At block 614, the lighting devices can power off. The lighting devices may power off in response to a user pushing the power button on the keypad. Alternatively, the lighting devices can include a predefined timing setting. The lighting devices may turn off in response to the predefined timing setting being satisfied. For example, the predefined timing setting can be powering off the lighting devices after an hour of continuous use.

Although the foregoing examples are useful in describing aspects of the invention, persons skilled in the art will recognize that the invention is not limited to use of any particular ones of the disclosed actions.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration A. A light controller for regulating operation of lighting devices such as pool and/or spa lights, wherein the light controller is remote from the lighting devices and includes one or more switch positions each corresponding to a light program for the lighting devices, and wherein LEDs associated with the light controller display one or more light settings of one of the light programs upon a switch being positioned at a respective switch position.

Illustration B. A lighting system, comprising: a lighting device; a light controller configured to control power and light settings to the lighting device; a computing system comprising a non-transitory computer-readable medium having instructions stored thereon, the instructions executable by a processing device to: receive a first input for a first light program for the lighting device, wherein the first input corresponds to a first position of a switch; display a first light setting associated with the first light program at the light controller; receive a selection input at the light controller; and set the lighting device to the first light setting.

Illustration C. A lighting system, comprising a lighting device and a light controller configured to control power and light settings to the lighting device, wherein the light controller is configured to: receive a first input for a first light program for the lighting device, wherein the first input corresponds to a first position of a switch; display a first light setting associated with the first light program at the light controller; receive a selection input; set the lighting device to the first light setting; receive additional inputs for additional light programs for the lighting device, each of the additional inputs corresponding to a different switch position; and display the additional light settings associated with the additional light programs at the light controller based on the switch position.

Illustration D. A light controller comprising: a keypad configured to transfer user input to a computing device, the keypad including at least one button; a switch mechanism including: a switch: and one or more switch positions, wherein each of the one or more switch positions corresponds with a different light program of a lighting device controlled by the light controller; and a removable cover positioned over the keypad, wherein the at least one button is configured to display light settings corresponding to the light program of a particular switch position of the one or more switch positions when the switch is in the particular switch position.

Illustration E. Methods for using the lighting system and/or light controller in any of the previous or subsequent illustrations of combinations of illustrations.

Illustration F. A light controller for regulating operation of at least one lighting device for a pool system, the light controller comprising: a switch and a plurality of switch positions, each switch position corresponding to a light program for the lighting devices, wherein the switch is movable to be at one of the plurality of switch position, and wherein the light controller is remote from the at least one lighting device.

Illustration G. The light controller according to any preceding or subsequent illustrations or combination of illustrations, further comprising: a housing comprising a housing area; a circuit board; and a covering, wherein the at least one light source is on the circuit board, wherein the circuit board is positioned within the housing area, and wherein the covering at least partially covers the circuit board.

Illustration H. The light controller according to any preceding or subsequent illustrations or combination of illustrations, wherein the switch is slidable between each switch position.

Illustration I. The light controller according to any preceding or subsequent illustrations or combination of illustrations, further comprising at least one light source, wherein the at least one light source displays one or more light settings of one of the light programs based on the switch being positioned at a respective switch position.

Illustration J. The light controller according to any preceding or subsequent illustrations or combination of illustrations, wherein the light setting displayed by the at least one light source when the switch is positioned in a first switch position of the plurality of switch positions is different from the light setting displayed by the at least one light source when the switch is positioned in a second switch position of the plurality of switch positions.

Illustration K. The light controller according to any preceding or subsequent illustrations or combination of illustrations, further comprising at least one button, wherein the at least one button displays the one or more light settings of one of the light programs.

Illustration L. A lighting system, comprising: a light controller configured to control power and light settings to a lighting device, wherein the lighting device is remote from the light controller; a computing system comprising a non-transitory computer-readable medium having instructions stored thereon, the instructions executable by a processing device to: receive a first input for a first light program for the lighting, device, wherein the first input corresponds to a first position of a switch; receive a selection input for the first light program at the light controller; and set the lighting device to the first light program.

Illustration M. The lighting system according to any preceding or subsequent illustrations or combination of illustrations, wherein the instructions further comprises instructions to: receive additional inputs for additional light programs for the lighting device, each of the additional inputs corresponding to a different switch position; and display the additional light settings associated with the additional light programs at the light controller based on the switch position.

Illustration N. The lighting system according to any preceding or subsequent illustrations or combination of illustrations, wherein the instructions further comprises instructions to display a first light setting of the first light program on a button of the light controller.

Illustration O. The lighting system according to any preceding or subsequent illustrations or combination of illustrations, wherein the light controller comprises a plurality of buttons, and wherein the instructions to receive the selection input comprise instructions to receive selection of one button of the plurality of buttons Illustration P. A lighting system comprising a light controller configured to control power and light settings to a lighting device, wherein the light controller is configured to: receive a first input for a light program for the lighting device, wherein the first input corresponds to a first position of a switch of the light controller; receive a second input for the light program, wherein the second input corresponds to a selection of a selectable feature on the light controller; and control the lighting device pursuant to the light program based on the first input and the second input.

Illustration Q. The lighting system according to any preceding or subsequent illustrations or combination of illustrations, wherein the light controller is configured to display a light setting associated with the light program on the at least one selectable feature.

Illustration R. The lighting system according to any preceding or subsequent illustrations or combination of illustrations, wherein the light controller is further configured to receive additional inputs for additional light programs for the lighting device, each of the additional inputs corresponding to a different switch position and control the lighting device pursuant to the additional inputs.

Illustration S. The lighting system according to any preceding or subsequent illustrations or combination of illustrations, wherein the light controller is further configured to display additional light settings associated with the additional light programs at the light controller based on the switch position.

Illustration T. A light controller comprising: a switch mechanism including: a switch and one or more switch positions, wherein each of the one or more switch positions corresponds with a different light program of a lighting device controlled by the light controller; and a removable cover configured to selectively cover the switch.

Illustration U. The light controller according to any preceding or subsequent illustrations or combination of illustrations, further comprising: a housing comprising a housing area; a light source configured to provide light pursuant to the light settings; a circuit hoard; and a covering, wherein the light setting is on the circuit board, wherein the circuit board is positioned within the housing area, and wherein the covering at least partially covers the circuit board.

Illustration V. The light controller according to any preceding or subsequent illustrations or combination of illustrations, further comprising a user interface configured to transfer user input to a computing device.

Illustration W. The light controller according to any preceding or subsequent illustrations or combination of illustrations, wherein the user interface comprises at least one of a keypad or a touchscreen.

Illustration X. The light controller according to any preceding or subsequent illustrations or combination of illustrations, wherein the removable cover covers the switch without covering the user interface.

Illustration Y. The light controller according to any preceding or subsequent illustrations or combination of illustrations, wherein the user interface comprises at least one selectable feature, wherein the at least one selectable feature is configured to display light settings corresponding to the light program of a particular switch position of the one or more switch positions when the switch is in the particular switch position.

Illustration Z. The light controller according to any preceding or subsequent illustrations or combination of illustrations, wherein the at least one selectable feature comprises a tactile button or a virtual button.

Illustration AA. The light controller according to any preceding or subsequent illustrations or combination of illustrations, further comprising at least one light source for providing light pursuant to the light settings, wherein the least one selectable feature comprises an illumination region, and wherein the at least one light source displays the light setting in the illumination region of the least one selectable feature.

Illustration BB. A method for controlling a pool lighting device using a controller, the method comprising: receiving a first input for a light program for the lighting device, wherein the first input corresponds to a first position as switch on the light controller; receiving a second input for a light program, wherein the second input corresponds to a selection of a selectable feature on the light controller different from the switch; and setting the lighting device to the light program.

Illustration CC. The method according to any preceding or subsequent illustrations or combination of illustrations, further comprising: receiving additional inputs for additional light programs for the lighting device, each of the additional inputs corresponding to a different switch position; and displaying the additional light settings associated with the additional light programs at the light controller based on the switch position.

Illustration DD. The method according to any preceding or subsequent illustrations or combination of illustrations, wherein the selectable feature comprises a button on the light controller, and wherein the method further comprises displaying a light setting associate with the light program on an illumination region on the button of the light controller.

Illustration EE. A light controller for regulating operation of at least one lighting device for a pool system and remote from the at least one lighting device, the light controller comprising: a user interface comprising an illumination region, wherein the light controller is configured to control the at least one lighting device pursuant to a light program comprising a light setting and display a light setting associated with the light program for the at least one lighting device on the illumination region.

Illustration FF. The light controller according to any preceding or subsequent illustrations or combination of illustrations, wherein the user interface comprises a plurality of buttons, wherein the illumination region comprises a plurality of illumination regions, and wherein each button of the plurality of buttons comprises an illumination region.

Illustration GG. The light controller according to any preceding or subsequent illustrations or combination of illustrations, wherein the light program comprises a plurality of light programs, and wherein the light controller further comprises a switch comprising a plurality of switch positions, each switch position corresponding to one light program of the plurality of light programs for the lighting devices, and wherein the illumination region displays the light setting of the light program based on the switch being positioned at a respective switch position.

Illustration HH. A lighting system, comprising: a light controller configured to control power and light settings to a lighting device, the light controller comprising a user interface comprising one or more selectable features, each comprising at least one illumination region; a computing system comprising a non-transitory computer-readable medium having instructions stored thereon, the instructions executable by a processing device to: receive an input for a light program for the lighting device, wherein the input corresponds to a selection of one selectable feature of the plurality of selectable features, and display a light setting associated with the light program at the light controller.

Illustration II. The lighting system according to any preceding or subsequent illustrations or combination of illustrations, wherein the instructions further comprise instructions to set the lighting device to the light setting.

Illustration JJ. The lighting system according to any preceding or subsequent illustrations or combination of illustrations, wherein the one or more selectable features comprise a plurality of selectable buttons.

Illustration KK. The lighting system according to any preceding or subsequent illustrations or combination of illustrations, wherein the light controller further comprises a switch comprising a plurality of switch positions, each switch position corresponding to a light program for the lighting devices, wherein the instructions further comprise instructions to receive a switch position of the switch, and wherein the instructions to display the light setting comprise instructions to display the light setting based on the switch position and the selection of the one selectable feature.

Illustration MM. A method for controlling a pool lighting device using a light controller, the method comprising:

receiving an input for a light program for the lighting device, wherein the input corresponds to a selection of one selectable feature of the plurality of selectable features; and displaying a light setting associated with the light program at the light controller.

Illustration NN. The method according to any preceding or subsequent illustrations or combination of illustrations, wherein the input is a first input for the light program, wherein the method further comprises receiving a second input for the light program, wherein the second input corresponds to a position of a switch on the light controller, and wherein displaying the light setting associate with the light program comprises displaying the light setting for the light program based on the first input and the second input.

Illustration OO. The method according to any preceding or subsequent illustrations or combination of illustrations, further comprising controlling the lighting device pursuant to the light program.

Illustration PP. The method according to any preceding or subsequent illustrations or combination of illustrations, wherein controlling the lighting device comprises controlling the lighting device to display the light setting displayed on the light controller.

Illustration QQ. The method according to any preceding or subsequent illustrations or combination of illustrations, wherein the plurality of selectable features comprises a plurality of buttons, and wherein displaying the light setting comprises displaying the light setting on an illumination region on at least one button of the plurality of buttons of the light controller.

These examples are not intended to be mutually exclusive, exhaustive, or restrictive in any way, and the invention is not limited to these example embodiments but rather encompasses all possible modifications and variations and combinations within the scope of any claims ultimately drafted and issued in connection with the invention (and their equivalents). For avoidance of doubt, any combination of features not physically impossible or expressly identified as non-combinable herein may be within the scope of the invention.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described embodiments, nor the claims that follow.

That which is claimed:

1. A light controller for regulating operation of at least one lighting device for a pool system, the light controller comprising:

a switch;

a plurality of switch positions, the plurality of switch positions comprising three or more switch positions, each switch position corresponding to a light program for the at least one lighting device; and a cover movable relative to the switch, wherein the cover is configured to selectively provide or restrict access to the light controller, wherein the switch is slidable between each of the plurality of switch positions and to be at one of the plurality of switch positions, and wherein the light controller is remote from the at least one lighting device.

2. The light controller of claim 1, further comprising:

a housing comprising a housing area, a circuit board;

at least one light source; and a covering, wherein the at least one light source is on the circuit board, wherein the circuit board is positioned within the housing area, and wherein the covering at least partially covers the circuit board.

3. The light controller of claim 1, further comprising at least one light source, wherein the at least one light source displays a light setting associated with one of the plurality of the light programs based on the switch being positioned at a respective switch position.

4. The light controller of claim 3, wherein the light setting displayed by the at least one light source when the switch is positioned in a first switch position of the plurality of switch positions is different from the light setting displayed by the at least one light source when the switch is positioned in a second switch position of the plurality of switch positions.

5. The light controller of claim 1, further comprising at least one selectable feature different from the switch, wherein the light controller is configured to control the at least one lighting device based on a selection of the at least one selectable feature and based on the switch being positioned at a respective switch position.

6. The light controller of claim 5, wherein the at least one selectable feature comprises at least one button, wherein the at least one button comprises a tactile button or a virtual button.

7. The light controller of claim 5, wherein the light controller is configured to display a light setting associated with one of the plurality of the light programs based on the switch being positioned at a respective switch position.

8. A lighting system comprising a light controller configured to control power and light settings to a lighting device, wherein the light controller comprises:

a switch movable to a plurality of positions, wherein a position of the switch provides a first input for a light program for the lighting device; and a user interface comprising one or more selectable features different from the switch configured to be engaged by a user, the one or more selectable features and comprising an illumination region on at least one of the one or more selectable features, wherein a selection of a selectable feature provides a second input for the light program, wherein the light controller is configured to control the lighting device pursuant to the light program based on the first input and the second input and is configured to illuminate the illumination region on the one or more selectable features based on the first input and the second input.

9. The lighting system of claim 8, wherein the light controller is configured to display a light setting associated with the light program on at least one selectable feature of the one or more selectable features.

10. The lighting system of claim 8, wherein the light controller is further configured to receive additional inputs for additional light programs for the lighting device, each of the additional inputs corresponding to a different switch position and control the lighting device pursuant to the additional inputs.

11. The lighting system of claim 10, wherein the light controller is further configured to display additional light settings associated with the additional light programs at the light controller based on the switch position.

12. The lighting system of claim 8, wherein the one or more selectable features comprises a plurality of buttons of a user interface.

13. The lighting system of claim 12, further comprising a removable cover configured to selectively cover the switch without covering the user interface.

14. The lighting system of claim 8, wherein at least one selectable feature of the one or more selectable features is configured to display light settings associated with the light program of a particular switch position of the one or more switch positions when the switch is in the particular switch position.

15. A light controller for regulating operation of at least one lighting device for a pool system and remote from the at least one lighting device, the light controller comprising:

a selectable feature comprising a touch region configured to be engaged by a user, the selectable feature comprising an illumination region within the touch region, wherein the light controller is configured to control the at least one lighting device pursuant to a light program based on a selection of the selectable feature, and wherein the light controller is configured to display a light setting associated with the light program for the at least one lighting device on the illumination region.

16. The light controller of claim 15, wherein the selectable feature comprises a plurality of selectable features, and wherein each selectable feature of the plurality of selectable feature comprises an illumination region.

17. The light controller of claim 15, wherein the selectable feature comprises a tactile or virtual button of a user interface.

18. The light controller of claim 15, wherein the light program comprises a plurality of light programs, wherein the light controller further comprises a switch movable to a plurality of switch positions, each switch position corresponding to one light program of the plurality of light programs for the lighting devices, and wherein the light controller is configured to control the at least one lighting device based on the selection of the selectable position and a particular switch position of the switch.

19. The light controller of claim 18, wherein the illumination region displays the light setting of the light program based on the switch being positioned at a respective switch position.

* * * * *